United States Patent [19]

Garbuzov

[11] Patent Number: 4,574,953

[45] Date of Patent: Mar. 11, 1986

[54] CONTAINER FOR FRAGILE ARTICLES

[76] Inventor: Oleg Garbuzov, 5873 Melrose Ave., Los Angeles, Calif. 90038

[21] Appl. No.: 666,482

[22] Filed: Oct. 30, 1984

[51] Int. Cl.[4] ..... B65D 85/30

[52] U.S. Cl. ..... 206/522; 206/314; 383/3

[58] Field of Search ..... 206/314, 522; 383/3; 150/52 R, 52 E; 52/2; 135/20 B, 87

[56] References Cited

U.S. PATENT DOCUMENTS

| | | | |
|---|---|---|---|
| 2,462,215 | 2/1949 | Norman et al. | 383/3 |
| 2,587,033 | 2/1952 | Dobbs et al. | 383/3 |
| 2,782,794 | 2/1957 | White | 52/2 |
| 3,005,567 | 10/1961 | White | 206/522 |
| 3,204,678 | 7/1965 | Worcester | 383/3 |
| 3,587,794 | 6/1971 | Mattel | 206/522 |
| 4,044,867 | 8/1977 | Fisher | 206/522 |
| 4,164,970 | 8/1979 | Jordan | 206/522 |
| 4,215,778 | 8/1980 | Kovins | 206/314 |
| 4,427,113 | 1/1984 | Wanner | 206/314 |
| 4,465,188 | 8/1984 | Soroka et al. | 206/522 |
| 4,489,833 | 12/1984 | Bauer | 206/522 |

FOREIGN PATENT DOCUMENTS

| | | | |
|---|---|---|---|
| 1141941 | 12/1962 | Fed. Rep. of Germany | 206/522 |
| 2754061 | 6/1979 | Fed. Rep. of Germany | 206/522 |
| 2417448 | 10/1979 | France | 206/522 |

*Primary Examiner*—Joseph Man-Fu Moy
*Assistant Examiner*—David Fidei
*Attorney, Agent, or Firm*—Bruce L. Birchard

[57] ABSTRACT

A container for fragile articles, such as musical instruments, includes an outer cover of scuff-resistant fabric which is compartmentalized to receive cooperating and similarly sized and shaped, shock-absorbing, inflatable, insert having finger-like elements, pneumatically interconnected to each other thru a header and also connected with an inflatable end-cover portion the latter cooperating with an end cover portion of the outer container cover to envelope the fragile article and protect it from shock and possible destruction in transit; the inflatable insert being easily removed for repair or replacement in the event of a puncture.

5 Claims, 3 Drawing Figures

CONTAINER FOR FRAGILE ARTICLES

BACKGROUND OF THE INVENTION

1. Field of the Invention

This invention relates to containers for fragile articles, such as musical instruments, and, more particularly to such containers having inflatable shock-resisting elements for enveloping the fragile article.

2. Prior Art

A search of the United States Patent and Trademark office has revealed the following patents which are related to, but do not anticipate, my invention.

U.S. Pat. No. 4,215,778 (Kovins) shows an instrument case with an inflatable outer case and a pair of opposed, inflatable inner members which are secured in the inflatable outer case. There is no external covering over the inflatable outer case and, if punctured, the outer case would be discarded. Further, if the inner inflatable members are punctured, they cannot be easily replaced because they are secured to the outermost inflatable case through portion 64 (col.4,1.8). Thus, the structure of Kovins would be expensive to manufacture and difficult or impossible to repair.

U.S. Pat. No. 4,262,801 (Avery) shows inner and outer container bodies "sealingly attached" to each other. Thus, a puncture in either the outer or inner container makes the entire container worthless, since the defective portion cannot be replaced.

U.S. Pat. No. 4,044,867 (Fisher) is directed to inflatable luggage which has no outer protection and which, if punctured would become useless.

Therefore, it is an object of the present invention to overcome the various disadvantages of prior art inflatable containers.

It is a further object of my invention to provide a shock-proof container for musical instruments, or the like, which utilizes an easily replaceable inflatable element.

SUMMARY OF THE INVENTION

A flexible, outer container cover is compartmentalized to receive corresponding, shock-absorbing, inflatable finger-like elements, pneumatically interconnected to each other and to an inflatable end cover which cooperates with the end flap of the outer container cover to envelope an article, such as a musical instrument, thus protecting such instrument from shock in transport or handling. Closure of the overall container may be achieved by a zipper. If the inflatable insert is punctured, it may be easily removed from the outer container for repair or replacement.

BRIEF DESCRIPTION OF THE DRAWINGS

The objects, features and advantages of this invention and the manner of obtaining them will become more apparent, and the invention itself will best be understood from a study of the following description of the invention taken in conjunction with the attached drawings, in which.

DETAILED DESCRIPTION OF THE PREFERRED EMBODIMENT

Figure 1:
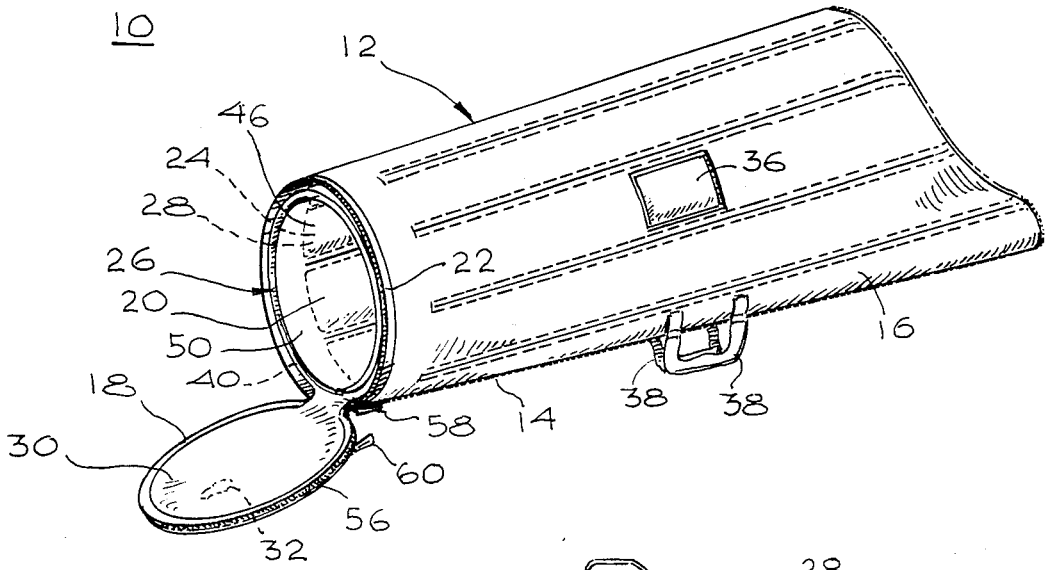
FIG. 1 is a perspective view of the container according to my invention.

In FIG. 1, container 10, which may be a case for a musical instrument, for example an alto saxophone, includes an outer cover 12 of any one of the presently available plasticfiber-based fabrics which are scuff resistant. Container 10 is closed by means of a sliding fastener or zipper 14, insofar as the body portion 16 of container 10, is concerned. End flap 18 closes off end opening 20 of container 10 and is secured to body portion 16 of container 10 by means of slide fastener 22. Container 10 has compartments 24 seen more clearly in FIG. 3 for receiving an inflatable insert 26 which has finger portions 28 and end portion 30 both of which may be seen more clearly in FIG. 2. End portion 30 of inflatable insert 26 carries inflation nozzle 32 for pneumatically inflating insert 26 after fingers 28 are in position in pockets 46 in outer cover 12 of container 10. These pockets may be seen more clearly in FIG. 3. Of course, container 10 may be of any desired shape to fit the fragile item to be transported. The container of FIG. 1 is designed for carrying an alto saxophone. An outer pocket 36 may be provided for carrying miscellaneous items, such as reeds, for the instrument or device container in container 10. For ease of transportation handles 38 are provided.

Figure 2:
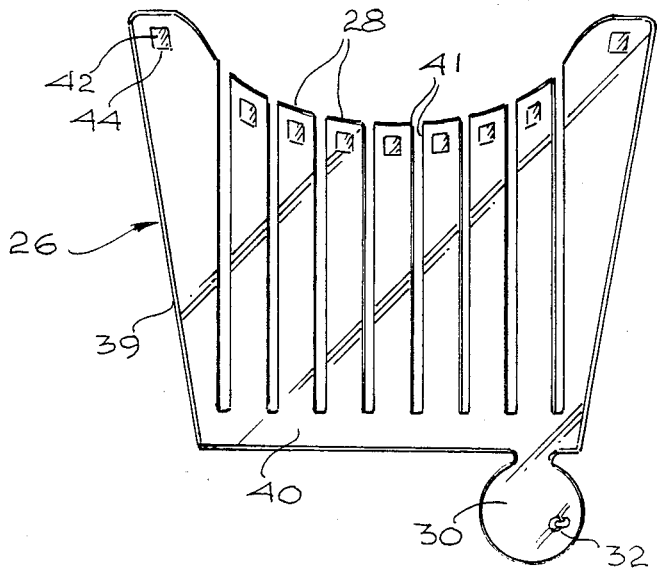
FIG. 2 is a plan view of a first portion of my invention.

In FIG. 2, insert 26 may be formed by overlaying two sheets of impervious thermo-plastic material cut to the proper pattern for the container which is contemplated; the two sheets are then thermally bonded or sealed along periphery 39 and, in addition are sealed in regions 41, after which those regions are cut, centrally, to the edge of header 40. Nozzle 32 is sealed into end cover 30. Insert 26 includes a header portion 40 which communicates with each of the fingers and with end cover portion 30 for the flow of pressurizing air therethrough to cause inflation of the fingers 28. Each of the fingers 28 has a pocket 42, open at end 44 to permit the use of a rod or stick in connection with the insertion of fingers 28 is the corresponding finger-receiving pockets 46 shown in FIG. 3.

Figure 3:
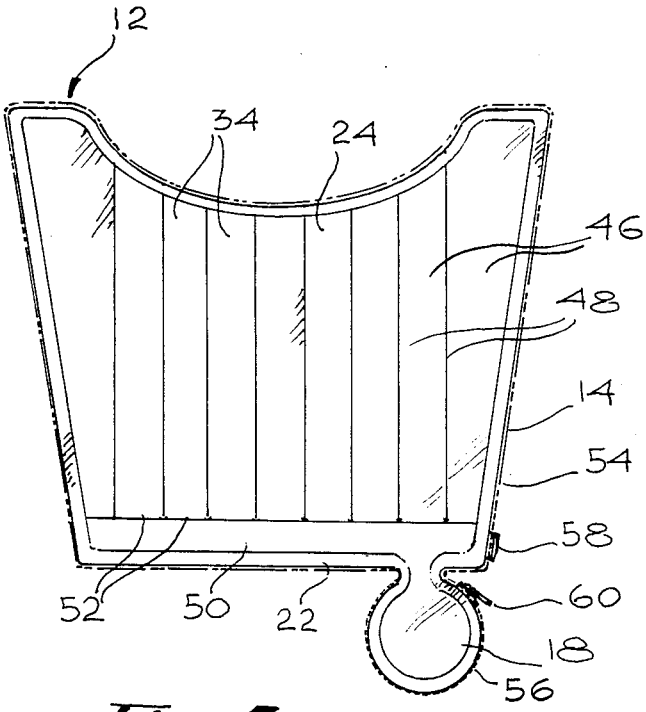
FIG. 3 is a plan view of a second portion of my invention designed to cooperate with the structure of FIG. 2.

In FIG. 3, outer cover 12 is sized and shaped to receive fingers 28 in the pockets 46 formed therein by boundaries 48 between adjacent pockets. End cover 18 is adapted to fold over the end of the closed container, as is more clearly set forth in FIG. 1. Region 50 is provided in outer cover 13 to receive header 40 of insert 26. Each of the compartments 34 has an entrance opening 52 adapted to receive fingers 28 of insert 26.

Outer cover 12 carries along its periphery zipper means 14. A separate sliding fastener or zipper means 22 is provided along end cap 18 of outer cover 12.

In the event that insert 26 is punctured it will, of course, become deflated and may be easily withdrawn from outer cover 12. A new insert 26 may then be inserted by pushing fingers 26 into compartments 46 and after the fingers have been inserted, using, if necessary, insert pusher pockets 42, air is introduced by blowing or pumping air into nozzle 32. End portion 30 of insert 26 communicates with header 40 which, in turn, communicates with each of the fingers 28 for the passage of air therethrough to effect the desired inflation.

The insertion of insert 26 in a deflated state may be done with outer cover 12 laid out in the fashion shown in FIG. 3, after which outer cover 12 may be closed by means of zipper 14 and its closing element 58. Insert 26 is then inflated and container 10 takes the shape shown in FIG. 1. End cover 18 may then be moved into a position to close opening 20 and its sliding fastener 22 may be operated by closure element 60.

While a particular embodiment of this invention has been shown and described, it will be apparent to those skilled in the art that variations and modifications may be made therein without departing from the spirit and scope of this invention. It is the purpose of the appended claims to cover all such variations and modifications.

I claim:

1. A container for one or more fragile articles; including:

an outer cover having a first size and a first outline shape related to the size and shape of said fragile articles, said outer cover including a plurality of compartments extending substantially throughout the extent of said outer cover;

an inflatable insert having an outline shape corresponding to said first outline shape and a size comparable to said first size and comprising a plurality of inflatable fingers sized and shaped to be received by said compartments in said outer cover, an inflatable end cover and a header pneumatically intercoupling said inflatable end cover and said inflatable fingers;

each of said inflatable fingers carrying a pusher pocket on the external surface thereof;

said outer cover including, in addition, an end flap, positioned to cover said end portion of said insert when said container is closed and an external pocket;

and a sliding fastener carried by said cover for selectively closing said container.

2. Apparatus according to claim 1 in which said end cover; carries an inflation nozzle.

3. A container for one or more fragile articles, including:

an outer cover having a first outline shape and a first size and including a plurality of adjacent compartments extending substantially throughout the extent thereof;

an insert having an outline shape corresponding to said first outline shape and a size comparable to said first size and comprising a plurality of inflatable fingers sized and shaped to be received by said compartments, and an inflatable end portion;

a header pneumatically inter-coupling said plurality of inflatable fingers with each other and with said end portion;

container closure means carried by said outer cover;

said cover including, in addition, an end flap, said end flap covering said end portion of said insert upon closure of said container by said container closure means.

4. A container for one or more fragile articles, including:

an outer cover having a first outline shape and a first size and including a plurality of adjacent compartments extending substantially throughout the extent thereof;

an insert having an outline shape corresponding to said first outline shape and a size comparable to said first size and comprising a plurality of inflatable fingers sized and shaped to be received by said compartments, and an inflatable end portion;

a header pneumatically inter-coupling said plurality of inflatable fingers with each other and with said end portion;

container closure means carried by said outer cover;

said one or more articles being a musical instrument and said first outline shape and said first size being such as to snugly accommodate such musical instrument.

5. Apparatus according to claim 3 in which each of said plurality of inflatable fingers carries a pusher pocket on the outer surface thereof.

* * * * *